US006220392B1

(12) United States Patent
Schwoerer

(10) Patent No.: US 6,220,392 B1
(45) Date of Patent: Apr. 24, 2001

(54) SCAFFOLD WITH VERTICAL AND TRANSVERSE SUPPORTS

(75) Inventor: Artur Schwoerer, Senden (DE)

(73) Assignee: Peri GmbH, Weissenhorn (DE)

( * ) Notice: Subject to any disclaimer, the term of this patent is extended or adjusted under 35 U.S.C. 154(b) by 0 days.

(21) Appl. No.: 09/381,325

(22) PCT Filed: Mar. 18, 1998

(86) PCT No.: PCT/EP98/01586

§ 371 Date: Dec. 29, 1999

§ 102(e) Date: Dec. 29, 1999

(87) PCT Pub. No.: WO98/41713

PCT Pub. Date: Sep. 24, 1998

(30) Foreign Application Priority Data

Mar. 19, 1997 (DE) ..... 197 11 496

(51) Int. Cl.[7] ..... E04G 1/16

(52) U.S. Cl. ..... 182/186.8; 182/186.7

(58) Field of Search ..... 182/186.7, 186.8, 182/178.1, 179.1; 403/49; 211/192, 191

(56) References Cited

U.S. PATENT DOCUMENTS 2,752,206 6/1956 Kirkpartrick .
3,685,665 * 8/1972 Atwater ..... 211/191
4,074,812 * 2/1978 Skubic ..... 211/192
4,379,430 * 4/1983 Ruschitzka ..... 211/192
4,955,743 * 9/1990 King ..... 211/192
5,180,068 * 1/1993 Vargo ..... 211/192

FOREIGN PATENT DOCUMENTS 1230190 12/1966 (DE) .
2 044 079 * 10/1980 (GB) ..... 211/192

* cited by examiner

*Primary Examiner*—Alvin Chin-Shue
(74) *Attorney, Agent, or Firm*—Townsend and Townsend and Crew LLP

(57) ABSTRACT

The invention relates to a scaffolding, especially facade scaffolding, comprising vertical poles (11) located one behind the other, preferably in pairs, and interconnected at given vertical intervals by means of cross struts (12). Said vertical poles (11) consist preferably of individual elements (11') and form carrier frames (43) with said cross struts (12). Base plates (13) are also positioned between the cross struts (12) of neighboring carrier frames (43). Diagonal poles (27) are arranged between at least some of the neighboring vertical poles (11). According to the invention scaffolding of this type is configured in such a way that at least one end of the diagonal poles (27) engages in an aperture (16) provided in the designated vertical pole (11) by means of a hook (15, 15'). Said opening lies at least essentially in the plane defined by the axes (17) of the neighboring vertical poles (11).

23 Claims, 7 Drawing Sheets

13
13'
14
14'
12
P
25
31
24
26
29
30
20
28
23'
21
S
16
16''
19
15
22
23
23''
17
11
27
18
16'
33
15'
34

SCAFFOLD WITH VERTICAL AND TRANSVERSE SUPPORTS

BACKGROUND OF THE INVENTION

The invention relates to a scaffold, in particular facade scaffolds.

Facade scaffolds are, for example, known from DE 196 33 091 A1 and serve in general the purpose of being erected in front of the facade of a building construction in order to carry out work on it, for example plaster work or painting work. The diagonal supports which serve to stabilize the scaffold against horizontal shifts normally extend from a point directly above one transverse strut to a point of the neighboring vertical support which lies slightly below the transverse strut located above it. The diagonal struts must be secured to the vertical supports so that both tensile forces and also compression forces can be exerted by the vertical supports onto the diagonal supports.

In known scaffolds forwardly projecting tilting fingers are provided for this purpose at the relevant points of the vertical supports, onto which bores complementary thereto at the ends of the diagonal supports are pushed. Another possibility consists in welding onto the vertical supports at the relevant positions suitable fittings with which the ends of the diagonal supports can be brought into the required engagement. The disadvantage of the known scaffolds lies in the fact that, on being loaded, the diagonal supports exert torsional moments onto the vertical supports and in that special components must be mounted on the vertical supports in order to be able to secure the diagonal supports.

A lightweight grid support construction is known from EP-A-0 140 948, which consists of vertical and horizontal support elements and also diagonal struts arranged therebetween. In order to avoid welded connections with this lightweight grid support construction, and to simplify installation, the vertical and horizontal support elements are connected by means of installable node connectors which have a form-locked and force transmitting connection to the vertical and horizontal support elements, with the node connectors each being divided into two half shells, which surround the vertical support elements in force transmitting manner and engage by means of projections in form-fitted manner into corresponding holes of the vertical support elements, and the node connectors furthermore forming connection spigots, onto which the horizontal support elements can be pushed and retained in force transmitting manner.

A scaffold with vertical, horizontal and diagonal supports is described in U.S. Pat. No. 2,435,171, in which pairs of vertical sleeves are welded onto the vertical supports in order to receive therein the bent around ends of the diagonal supports.

U.S. Pat. No. 1,552,233 shows a scaffold having vertical, horizontal and diagonal supports in which holes are provided in the walls of the vertical supports extending perpendicular to the plane defined by the vertical and diagonal supports and in which the bent around ends or fastening pins for the diagonal and horizontal supports are arranged.

Finally, U.S. Pat. No. 3,330,583 discloses a safety catch with which support tubes can be secured to vertical rails provided with openings.

SUMMARY OF THE INVENTION

It is an object of the present invention is to provide a scaffold of the initially named kind in which no special components have to be provided on the vertical supports for the mounting of the diagonal supports and in which at least no substantial torsional moments are exerted by the diagonal supports onto the vertical supports.

An important advantage attained with the present invention is the fact that the diagonal supports can be mounted with their ends via hooks directly in openings provided at the relevant positions, in particular in elongate holes of the vertical supports, with the position of the openings being such that torsional moments are not transmitted to the vertical supports when exerting either tensile forces or compressive forces on the diagonal supports. In this manner not only is the constructional complexity for the scaffold of the invention minimized, but rather the strong design which is otherwise necessary to accommodate torsional moments can be avoided.

Although, as a result of the measures of the invention, a once installed diagonal support is already secured as a result of weight and frictional forces against undesired release from the vertical supports, it is nevertheless preferred when a bolt is provided, to secure the upper hook in particular in its hung-in position.

An advantageous practical embodiment of the invention secures the diagonal support by gravity.

The invention further contemplates arrangements, particularly for embodiments of the actuating lever or of the actuating lug, in which the latched position is secured by gravity, which prevents that the hook of the diagonal which support to be placed at the bottom is unintentionally hung into an opening of the vertical support at the top. If this occurs the hook with bolt securing would now be located at the lower side and could no longer be secured by gravity.

Further, the present invention allows diagonal supports to be optionally mounted at the one or other side of a vertical support at each level.

DESCRIPTION OF THE PREFERRED EMBODIMENT

Figure 1:
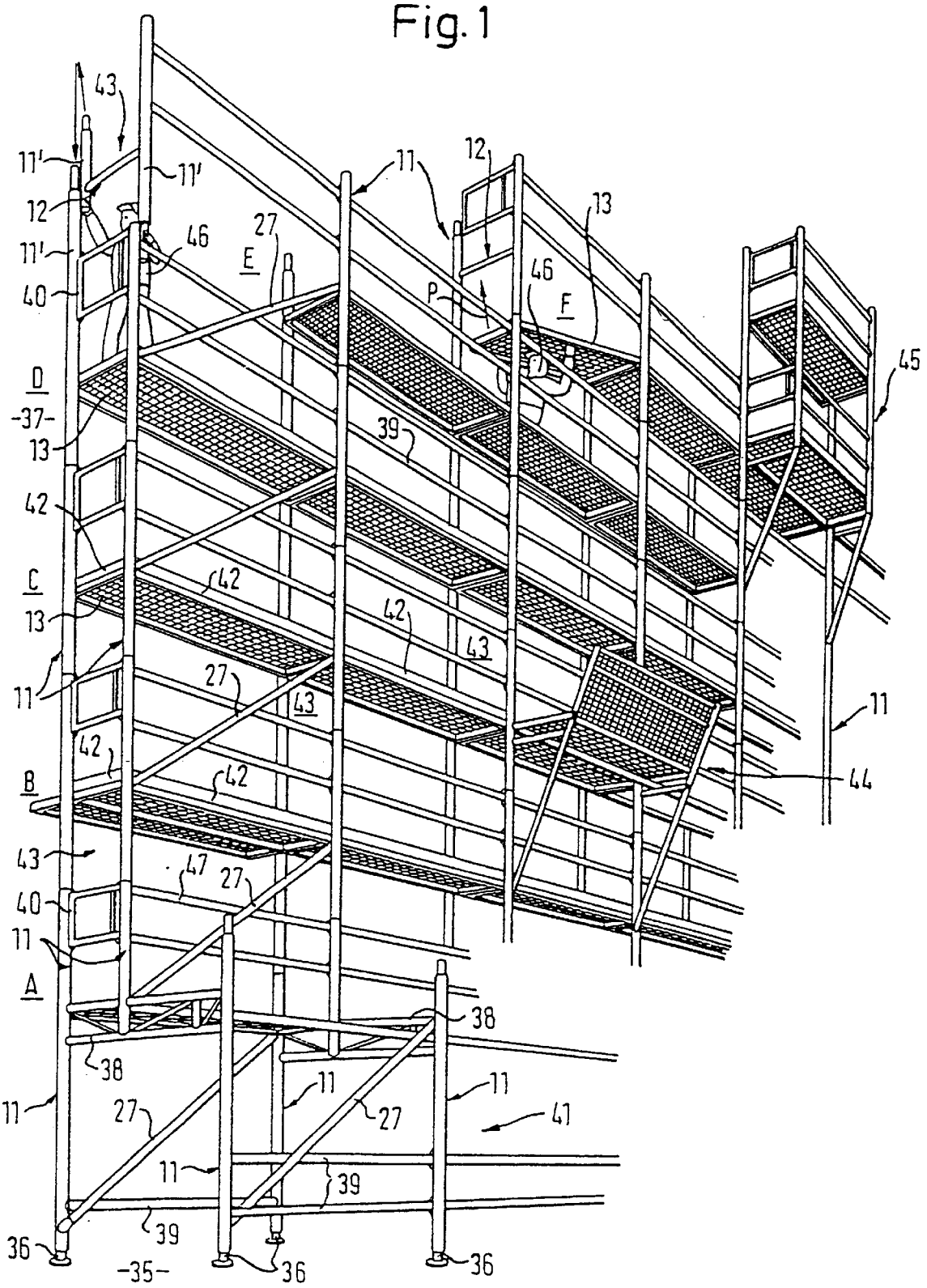
FIG. 1 is a schematic perspective view of a facade scaffold being erected, which can be formed in accordance with the invention.
Figure 2:
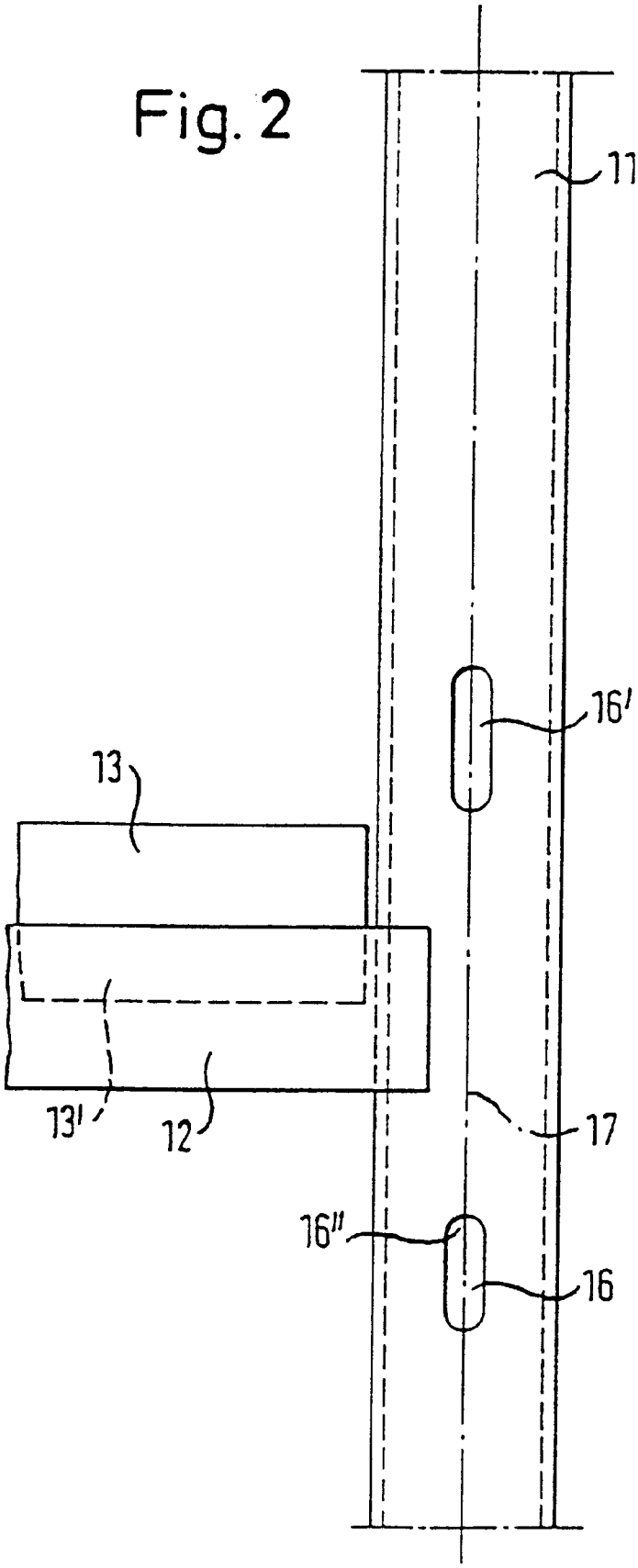
FIG. 2 is an enlarged part view of a vertical support formed in accordance with the invention seen in a horizontal direction extending parallel to the building construction and indeed in the region of the connection of a transverse strut with a floor panel lying on it.

In accordance with FIG. 1 a facade scaffold is being built up at a building construction 37. Four vertical supports 11 are supported on the earth 35 in an arrangement with a rectangular base surface, the longer side of which extends parallel to the front of the building construction 37, via vertically adjustable spindle arrangements 36, and are completed into a load carrying basic framework 41 by upper transverse beams 38, longitudinal supports 39 and diagonal struts 27, with the basic framework continuing in a suitable manner at the bottom right in FIG. 1, which is not illustrated in detail. The basic framework 41 has no transverse struts in the lower region, so that a passage, for example for pedestrians, can be provided there.

Carrier frames 43, which are assembled from plugged together individual elements 11' forming vertical supports 11 and horizontal transverse struts 12, are plugged onto two vertical supports 11 of the basic framework 41, which are offset rearwardly relative to the front vertical support 11 and arranged at a small spacing behind one another. As one can recognize from the top left in FIG. 1, numerous carrier frames 43 are plugged together, through the intermediary of individual elements 11' not connected to transverse struts 12, such that in each case one transverse strut 12 is present in the vertical spacing of stories A, B, C, D, E and F. A total of seven carrier frame arrangements consisting of assembled together carrier frames 43 disposed vertically above one another, with transverse struts 12 respectively lying at the same level, are provided along the building construction 37 at uniform intervals.

The narrow sides of rectangular floor panels 13 are releasably placed onto two transverse struts 12 arranged alongside one another along the building construction 37.

The facade scaffold furthermore has two forwardly projecting auxiliary scaffolds 44 and 45 respectively.

The front vertical supports 11 at the corners of the basic framework 41 can be used for adding further carrier elements.

For the safety of the people 46 working on the floor panels 14, railings 40, 47 are secured to the vertical supports 11 at a suitable level at the sides and also at the end faces.

Curb strips 42, which are intended to prevent tools lying on the floor panels 13 being pushed sideways beyond the floor panels 14 and falling downwardly from the facade scaffold during walking, are in particular releasably secured at the side of the floor panels 13 remote from the building construction 14 and, to the extent necessary, also at the side adjacent the building construction 37 and at the end faces.

The stories A, B, C, D are already finished while the stories E, F are just being built up.

Figure 3:
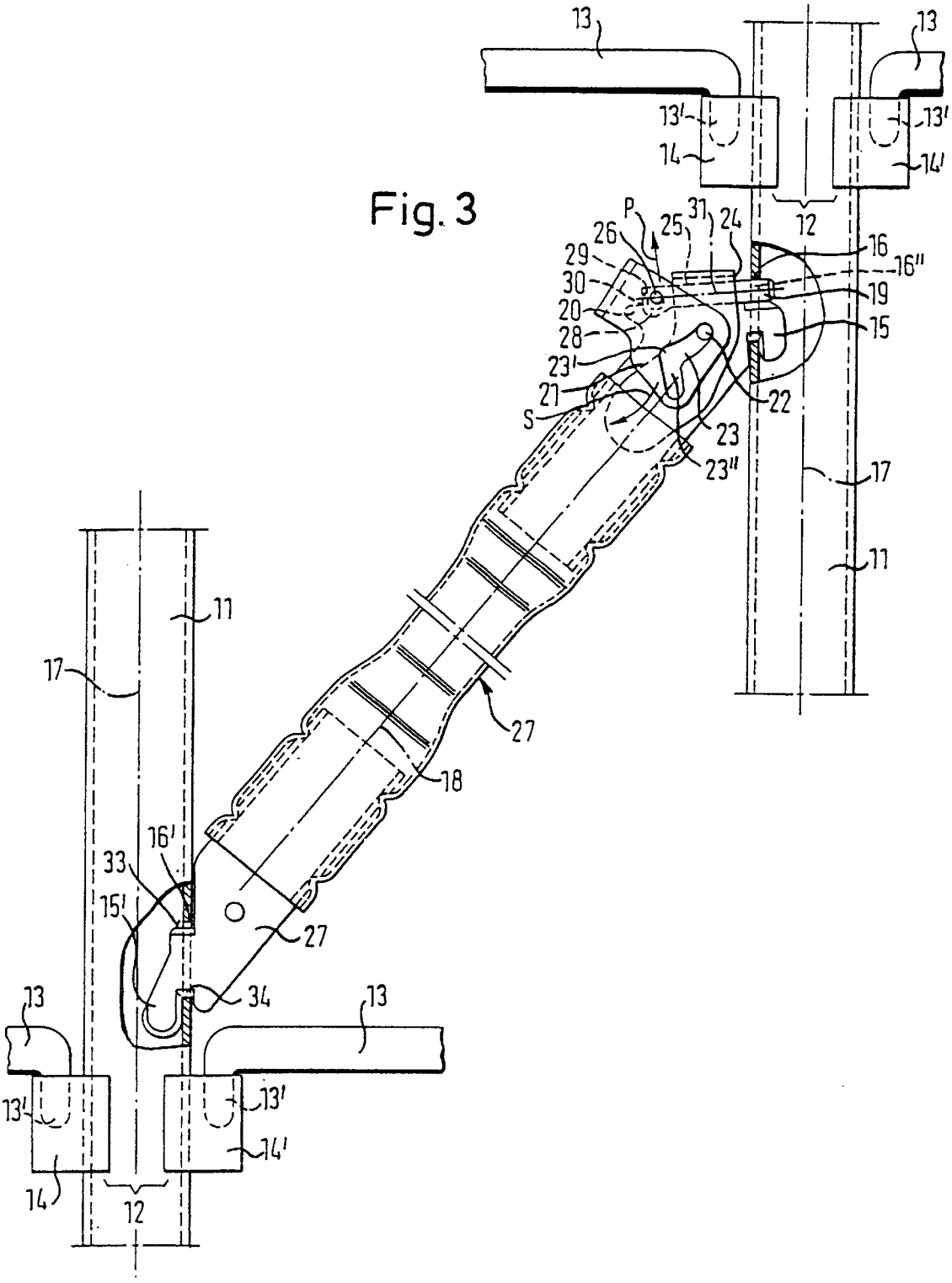
FIG. 3 is a partial front view of a scaffold in accordance with the invention, with a diagonal support arranged between two vertical supports, with the upper attachment being in the latched position.
Figure 4:
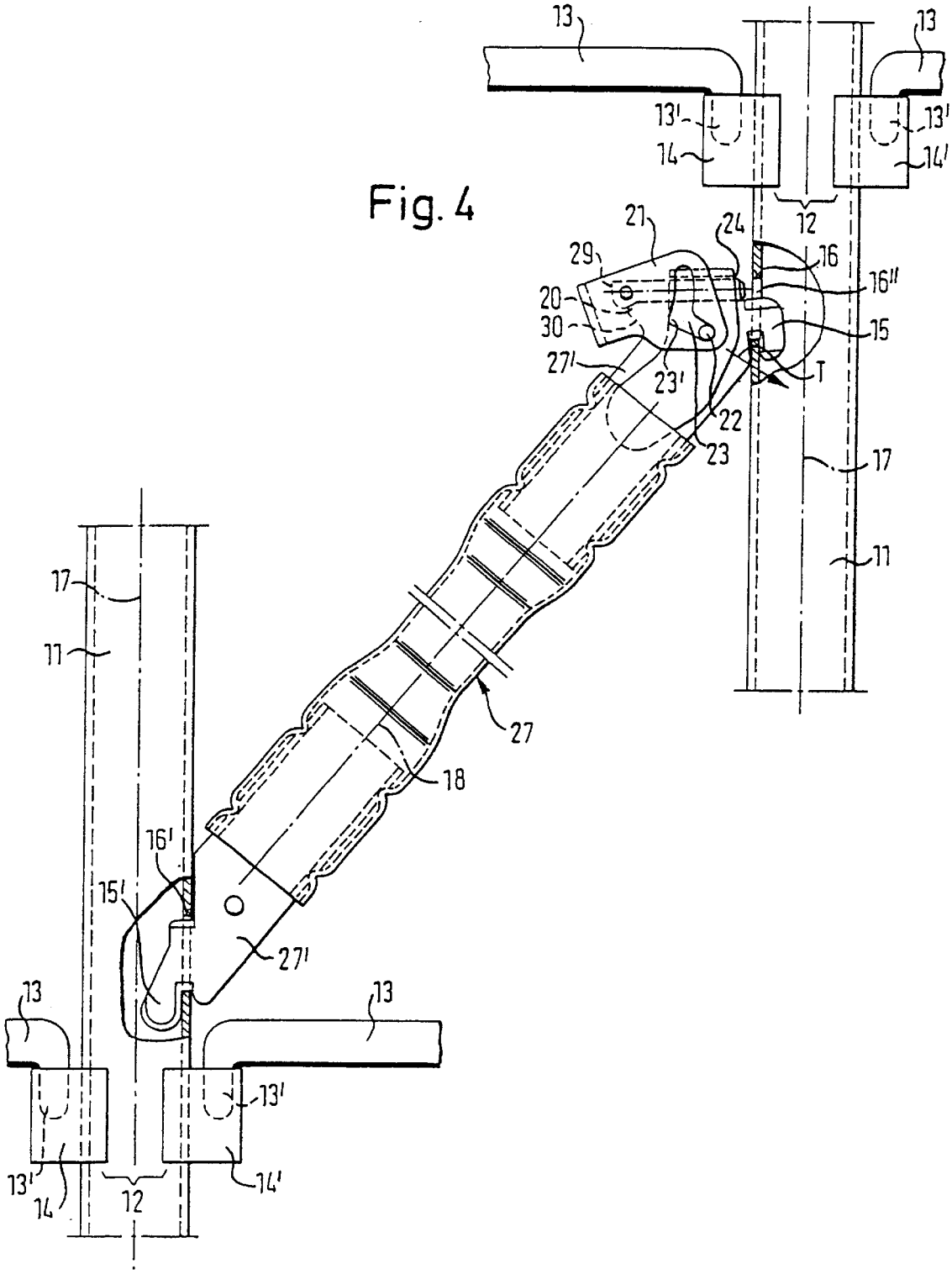
FIG. 4 is a view analogous to FIG. 3, with the upper attachment of the diagonal support being unlatched for the removal of the diagonal support.

In accordance with FIGS. 3 to 4 the transverse struts 12 consist of two rail sections 14, 14' mounted by welding or by a releasable type of attachment to two vertical supports 11 located behind one another and spaced apart parallel to one another. Hook-like projections 13' at the ends of the floor plates can engage behind the rail sections in the manner schematically indicated in FIGS. 2 to 5 in order to releasably support the floor panels 13 on the transverse struts 12.

In accordance with FIGS. 2 to 6 a diagonal support 27 in accordance with the invention has at its upper end a downwardly projecting hook 15, and at its lower end likewise a downwardly pointing hook 15'. As one can in particular deduce from FIG. 2, the vertical supports 11 have at the side an elongate hole 16 directly beneath one transverse strut 12, and a further elongate hole 16' directly above the transverse strut 12, with the longitudinal directions of the elongate holes extending parallel to the axis 17 of the vertical support 11.

Figure 5:
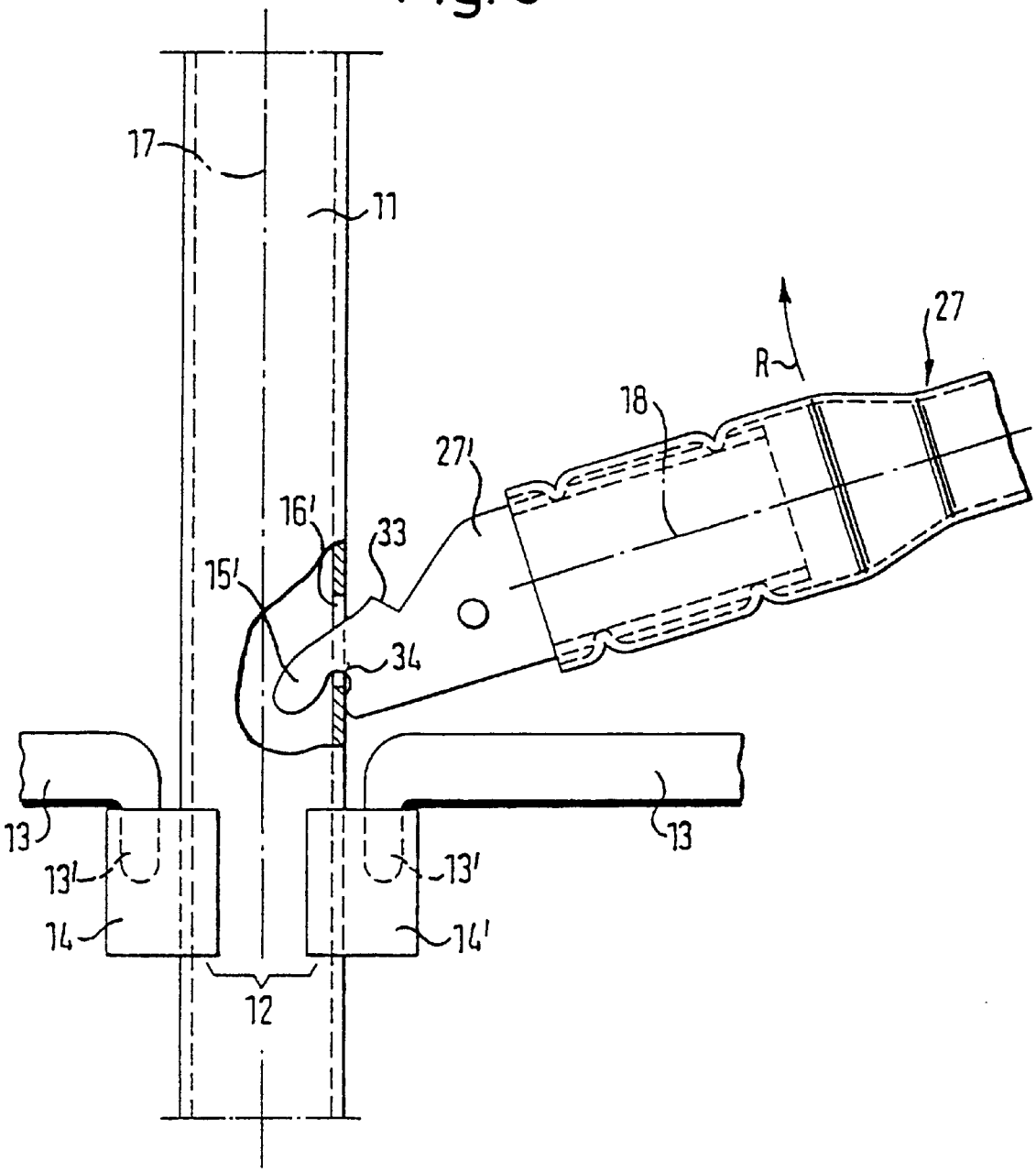
FIG. 5 shows the lower part of FIGS. 3 and 4 in the phase during the insertion or removal of the lower end of the diagonal support into or out of an elongate hole of the vertical support.
Figure 6:
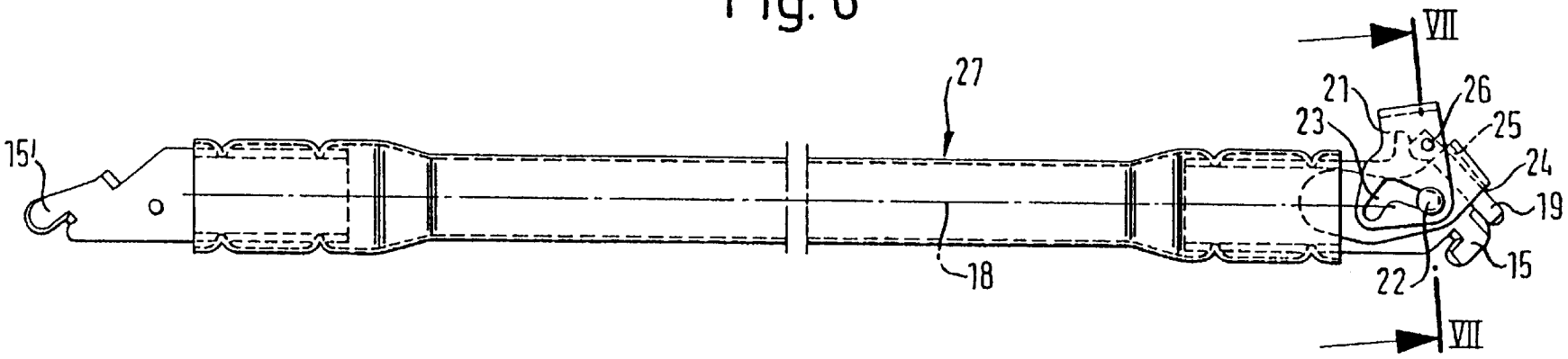
FIG. 6 is a side view of a diagonal support in accordance with the invention shown on a somewhat reduced scale.

In accordance with FIGS. 3 and 4 the lower hook 15' and the elongate holes 16' located above each transverse strut 12 are designed such that the hook 15' can be introduced substantially horizontally into the elongate hole 16, with the diagonal support 27 pivoted downwardly in accordance with FIG. 5 and can be brought by subsequent upward pivoting of the diagonal support 27 into the position of FIGS. 3, 4, where the hook 15' is pivoted downwardly, and produces in this position a firm connection between the vertical support 11 and the diagonal support 27, which is loaded in tension and compression.

In contrast, the upper hook 15 is so shaped that it can be brought from the end angular position of the diagonal support 27 evident from FIGS. 3 and 4 horizontally into the elongate hole 16 located beneath the transverse strut 12 and subsequently brought by lowering over the lower edge of the elongate hole 16 into the hung-in position evident from FIGS. 3 and 4. In this position, which is shown in FIG. 4, the diagonal support 27 is already adequately secured against tensile forces and also against compressive forces at the two vertical supports connected to it, since on exerting compressive forces the hook 15 can at most slide upwardly up to the upper edge of the elongate hole 16, where it is, however, held. When compressive forces reduce, then the hook 15 slides down again into its lower hung-in position.

In order, however, to avoid such to and fro sliding of the hook 15 with alternating forces, a latch pin 19 is provided above the hook 15 and is displaceably mounted to and away from the vertical support 11. At its rear end, the latch pin 19 has in accordance with FIG. 3 a downwardly extending projection 28, which cooperates with a complementary abutment 20 at the relevant end of the diagonal support 27 in such a manner that on engagement of the projection 28 behind the abutment 20, a backward movement of the latch pin 19 out of the latched position shown in FIG. 3 is impossible.

However, the mutually contacting end faces 29, 30 of the latch pin 19, on the one hand, and of the abutment 20, on the other hand, are arranged perpendicular to the axis 31 of the latch pin 19 such that through a movement of the end region of the latch pin 19 in the direction of the arrow P in FIG. 3, the end surfaces 29, 30 are brought out of engagement and thereby a return movement of the latch pin 19 is made possible.

In order to fix the latched position of the latch pin 19 within the upper region 16" (FIGS. 2 and 3), a transverse hinge 26 is provided in the rear region of the latch pin 19, on which an actuating lever 21 having an inverse U-shaped cross-section (FIG. 7) is hinged, which extends obliquely downwardly and towards the vertical support 11 in the latched position in FIG. 3 and which has a camtrack cutout 23 at a clear distance from the transverse hinge 26, with the cutout sitting on a transverse pin 22 secured in the end region of the transverse strut 27. For reasons of symmetry, the camtrack cutouts 23 and pins 22 of the same design should be provided in the two limbs of the actuating lever 21.

In the latched position, the actuating lever 21 is pulled downwardly by gravity as a result of an overweight of its region lying in front of the transverse hinge 26, so that a torque is exerted in the direction of the arrow S in FIG. 3 onto the actuating lever 21. In the latched position the pin 22 contacts the upper end of the camtrack cutout 23. From there the camtrack cutout extends first on a circular track around the transverse joint 26 in order to finally bend downwardly from a corner region 23' (FIG. 3) into a substantially straight piece (23"). The corner region 23' is arranged at such an angular spacing from the upper end of the camtrack cutout 23 in FIG. 3 that on pivoting the actuating lever 21 against the arrow S in FIG. 3 up to a position where the corner region 23' comes to lie on the transverse spigot 22, the rear region of the latch pin 19 can be pushed upwardly by pushing the actuating lever 21 upwardly, whereby the two end surfaces 29, 30 come out of engagement. For this purpose a corresponding clearance 25 is provided behind the guide opening 24 above the latch pin 19.

With this obliquely upward and rearward movement of the actuating lever 21, the straight piece 23", which now points substantially in the radial direction with respect to the transverse joint 26, slides on the transverse pin 22 up to and into the position shown in FIG. 4, with not only the end surfaces 29, 30 coming out of engagement, but also rather the latch pin 19 being withdrawn from the latched position shown in FIG. 3 into the unlatched position of FIG. 4.

In accordance with the invention, the elongate holes 16, 16' (FIGS. 2, 3 and 4) lie in the plane defined by the axes (17) of the two adjacent vertical supports 11, between which a specific diagonal support 27 extends in FIGS. 3 and 4. The axis 18 of the diagonal support 27 thus lies in the relevant plane. For this reason both tensile and also compressive forces which are transmitted by the diagonal supports 27 between the vertical supports 11 go through the axes 17 and torsional moments about the axes 17 are avoided.

Figure 7:
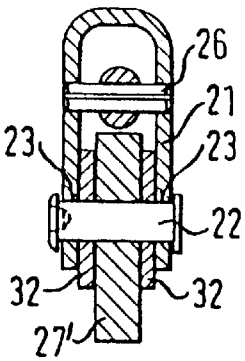
FIG. 7 is a section taken on line VII—VII in FIG. 6.

In accordance with FIG. 7 friction reducing discs 32 are arranged between the upper end region 27' and the two limbs of the actuating lever 21.

Further features and details of the invention will result from the following functional description:

After the vertical supports 11 of a story A, B, C, D, E or F have been erected, and optionally also the floor panels 13 inserted, diagonal struts 27 are installed in the field where diagonal struts 27 are provided, in that, in accordance with FIG. 5, first the lower end of the diagonal support 27 is introduced in an approximately horizontal or slightly upwardly angled position, with its lower hook 15' into the lower elongate hole 16', whereupon the diagonal support 27 is pivoted upwardly in the direction of the arrow R in FIG. 5, and indeed up to its desired angular position evident from FIGS. 3 and 4. During this, the lower hook 15' engages behind the lower edge of the elongate hole 16' and an upper horizontal step 33 of the hook 15' comes to lie directly below the upper edge of the elongate hole 16'. A lower cutout 34 between the hook 15' and the lower end region 27' of the diagonal support 27 comes to lie on the lower edge of the elongate hole 16'. The diagonal support 27 is now secured against shifting in its longitudinal direction 28 both upwardly and downwardly.

The upper region of the diagonal support 27 is now pivoted upwardly sufficiently far that the hook 15 provided there comes to lie in front of the upper elongate hole 16. Thereafter, the hook 15 is inserted, with the latch pin 19 retracted in accordance with FIG. 4, into the elongate hole 16, whereupon the hook hangs in over the lower edge of the elongate hole 16 as a result of the weight force, as is shown in FIGS. 3 and 4.

As a result of its actuating lever 21 being pivoted upwardly into its upper position, the latch pin 19 of FIG. 4 is first located in its unlatched position, so that the introduction of the hook 15 into the elongate hole 16 is not hindered. As soon as the position of FIG. 4 has now been reached, the actuating lever 4 is first shifted in the direction of the arrow T in FIG. 4, with the latch pin being displaced forwardly into the upper region 16" of the elongate hole 16 into the position of FIG. 3. During this, the end surfaces 29, 30 again enter into engagement, so that a return movement of the latch pin 19 is now prevented in form-locked manner.

In order to fix this state of engagement, the actuating lever 21 is pivoted in the clockwise sense into the position which is evident from FIG. 3, with the transverse pin 22 being located at the upper end of the camtrack cutout 23. This movement, executed simply through the weight force of the actuating lever 21, can, however, be assisted by the operator.

In the end position of the actuating lever 21 of FIG. 3 determined by gravity, a lifting out of the rear region of the latch pin 19 beyond the abutment 20 is precluded, so that the latched position of FIG. 3 is now fixed.

In order to prevent an inverted installation of the diagonal support 27, which would make the self-latching of FIG. 3 impossible, the lower elongate hole 16' is made longer than the upper elongate hole 16. If the operator now attempts to install the diagonal support 27 inverted, then this proves impossible because the hook 15' will not fit into the smaller elongate hole 16. The operator is thus forced to turn the diagonal support 27 around and to bring it into the correct position, where the lower hook 15' is arranged in the elongate hole 16' and the upper hook 15 in the upper elongate hole 16.

In accordance with the invention, the elongate holes are introduced by laser cutting, which has the advantage that in this way the strength of the vertical supports is hardly impaired in the area of the elongate holes 16, 16', and an extremely accurate positioning of the elongate holes 16, 16' is ensured.

Figure 8:
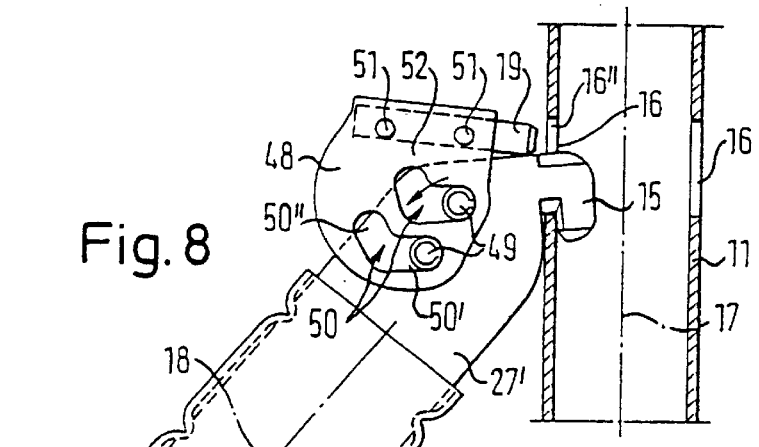
FIG. 8 is a partly sectioned side view of the upper part of a further embodiment of a diagonal support in the unlatched state and hung into a vertical support.
Figure 9:
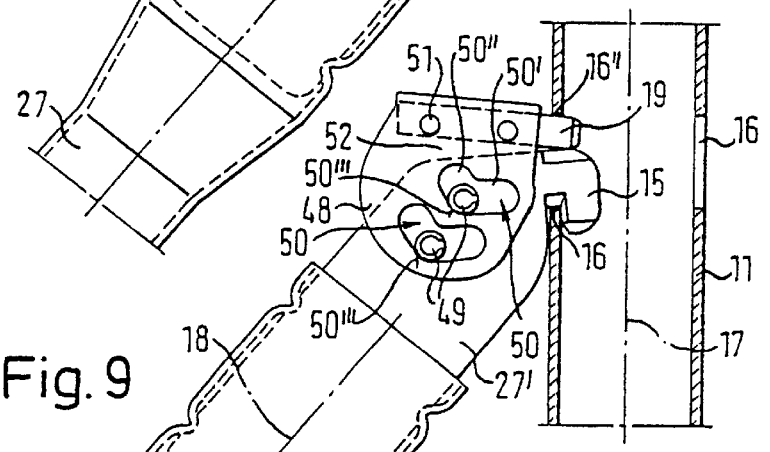
FIG. 9 is the same view as FIG. 8 during the latching procedure.
Figure 10:
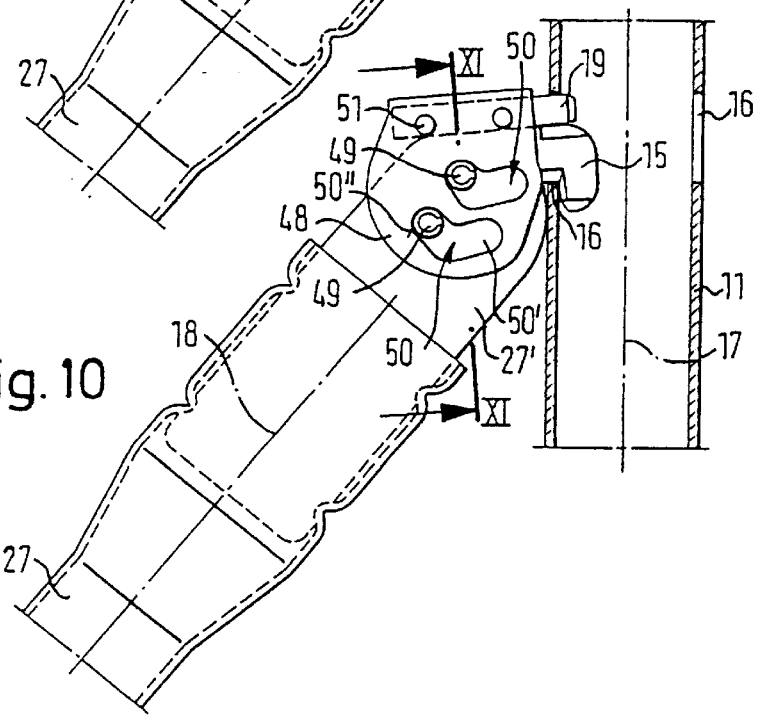
FIG. 10 is the same view as FIG. 8 in the latched state.

One thus first recognizes from FIGS. 8 to 10 that elongate holes 16 are expediently provided at diametrically oppositely disposed sides of the vertical supports 11, so that diagonal supports can optionally be provided on the one side or on the opposite side or also on both sides of a vertical support 11.

Figure 11:
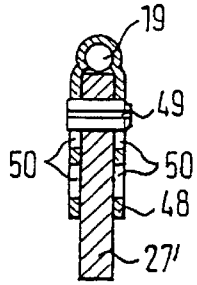
FIG. 11 is a section taken along the line XI—XI in FIG. 10.

In the embodiment of FIGS. 8 to 11, in which the same reference numerals designate corresponding components as in the previous description, the latch pin 19 is fixedly connected to an actuating lug of inverse, U-shaped cross-section, in that the latter is laid, in accordance with FIG. 11, around the rear region of the latch pin 19 and, for example, firmly connected to the latch pin 19 by means of rivets 51 (FIG. 8).

The limbs of the actuating lug 48 engage from above over the flat upper end region 27' of the diagonal support 27, which carries the upper hook 15, which is hung into an elongate hole 16.

The two limbs of the actuating lug 48 are provided with camtracks 50 at a distance above one another and offset somewhat sideways, with the camtracks extending in each case approximately parallel to the latch track, and having an at least substantially straight shifting region 50' and a latching region 50" following it at the rear, which is likewise at least substantially straight and extends at least substantially perpendicular to the latch track. Transversely extending pins 49 extend into the two camtracks 50 and are fixedly connected to the flat end region 27' of the diagonal support 27.

The operation of this embodiment results as follows from the sequence of FIGS. 8 to 10:

In the unlatched position of FIG. 8, the actuating lug 48 is retracted relative to the hook 15 as far as possible, so that the pins 49 are located at the support side end of the shifting region 50' of the camtrack 50. In this state the latch pin 19 is out of engagement with the elongate hole 16.

If now latching is to be produced, the actuating lug 48 is shifted by hand in the direction of the vertical support 11, with the latch pin 19 entering in accordance with FIG. 9 into the upper elongate hole region 16" and the camtracks 50 being initially shifted so far relative to the pins 49 that the pins 49 come to lie in the corner region 50"' of the camtrack 50. The latch pin 19 is now already in its latched position.

In order to secure this latched position, the actuating lug 48 is now pivoted downwardly substantially about the front end of the latch pin 19, with the latching region 50" of the two camtracks 50 sliding downwardly on the pins 49, until the pins 49 come into contact at the upper end of the latching regions 50", as can be recognized in FIG. 10. The design is preferably such that the movement of the actuating lug 48 out of the position of FIG. 9 into the position of FIG. 10 takes place solely as a result of the gravity force of the actuating lever 48 and the latch pins 19. In any event gravity causes the once established latching position of FIG. 10 to be retained.

As a result of the fact that the latching regions 50" extend at least substantially perpendicular to the latch track 19, or have at least a substantial component perpendicular to the latch track, a movement of the latch pin 19 in the unlatching direction is blocked.

In order for the actuating lug 48 to execute the pivotal movement from the position of FIG. 9 into the position of FIG. 10, a wedge gap 52 must be provided in the unlatched position of FIG. 8 or in the not yet secured position of FIG. 9 between the lower side of the latch pin 19 and the upper edge of the end region 27' and permit the pivotal movement from the position of FIG. 9 into that of FIG. 10.

The unlatching from the position of FIG. 10 takes place in the reverse sequence in that the actuating lug 48 is first pivoted upwardly by hand into the intermediate position of FIG. 9 and then drawn away from the vertical support 11 until the unlatched position of FIG. 8 is reached.

The arrangement of two or possibly more pin-camtrack arrangements extending parallel to one another has the advantage that the actuating lever or the actuating lug is unambiguously guided.

What is claimed is:

1. A scaffold comprising vertical supports arranged behind one another and connected by transverse struts at specific vertical intervals, the vertical supports defining vertical axes and with the transverse struts forming carrier frames, floor panels arranged between transverse struts of neighboring carrier frames, diagonal supports arranged between at least some of the neighboring vertical supports having longitudinal axes and a hook at each end of the diagonal supports, the vertical supports including elongate openings engaged by the hooks of the diagonal supports arranged between the neighboring vertical supports and located at least substantially in a plane defined by the vertical axes, the openings in the neighboring vertical supports facing each other, one of the hooks of each of the diagonal supports being secured in one of the associated elongate openings by swinging the diagonal support from an inserting position towards a final diagonal position and the other one of the hooks being insertable in the other one of the openings when the diagonal support is at least substantially located in the final diagonal position by moving the other one of the hooks in a direction at least substantially perpendicular to the vertical axis of the corresponding vertical support into the other one of the openings to thereby place the diagonal support in a fully inserted position, and a locking device securing each diagonal support in the fully inserted position with the hooks inserted in the respective openings of the neighboring vertical supports against tensile forces and against compressive forces.

2. A scaffold in accordance with claim 1 wherein the vertical supports comprise individual support elements connected to each other.

3. A scaffold in accordance with claim 1 wherein each opening is an elongate hole with a longitudinal extent parallel to the vertical axis of the associated vertical support.

4. A scaffold in accordance with claim 1 wherein each diagonal support in its final diagonal position has a relatively lower hook and a relatively higher hook, wherein the diagonal support, when it is in the inserting position, is relatively horizontal, and wherein the relatively lower hook becomes secured to the associated vertical support against being pulled out from the opening when the relatively lower hook extends through the opening and the diagonal support is in the final diagonal position.

5. A scaffold in accordance with claim 1 wherein each diagonal support in its final diagonal position has a relatively lower hook and a relatively higher hook, wherein the diagonal support, when it is at least substantially in its final diagonal position, is insertable in the opening of the associated vertical support by moving it in a direction at least substantially perpendicular to the vertical axis of the associated vertical support, the relatively upper hook and the associated opening being configured so that the hook becomes connected to the associated vertical support by lowering it over a lower edge of the associated opening, and can be disengaged from the associated vertical support by lifting the relatively higher hook over the lower edge of the associated opening, and wherein the relatively higher hook can be retracted from the opening by moving it at least substantially perpendicular to the vertical axis of and away from the associated vertical support.

6. A scaffold according to claim 5 including a bolt connected with the diagonal support above the relatively higher hook and movable relative to the diagonal support for extending the bolt into and retracting it from a portion of the associated opening located above and spaced from a lower edge of the opening.

7. A scaffold according to claim 6 wherein the bolt is arranged at an end of the diagonal support.

8. A scaffold according to claim 6 including a latching mechanism operatively coupled to the bolt for preventing a removal of the bolt from the opening when the latching mechanism is engaged.

9. A scaffold according to claim 8 including an abutment provided at an end of the diagonal support proximate the relatively higher hook, and including a form-fitted arrangement defined by the bolt and the abutment releasably maintaining the latch mechanism in its latched position.

10. A scaffold according to claim 9 including an actuating lever for moving the bolt into or out of engagement with the abutment for latching and unlatching the latching mechanism.

11. A scaffold according to claim 10 wherein the actuating lever is pivotally connected to the bolt, and including a pin-camtrack arrangement formed by the actuating lever and the diagonal support for controlling movement of the bolt between positions in which the bolt extends into and is retracted from the associated opening.

12. A scaffold according to claim 11 wherein a pivotal connection between the actuator lever and the bolt and the pin-camtrack arrangement are configured so that the actuating lever is gravitationally biased into its latched position.

13. A scaffold according to claim 6 wherein the diagonal support defines a guide opening proximate the relatively higher hook engaging the bolt and permitting movement of the bolt towards and away from the associated opening in the associated vertical support in a direction substantially perpendicular to the vertical axis of the associated vertical support.

14. A scaffold according to claim 13 wherein the guide opening has first and second ends which are proximate and remote, respectively, from the associated hole in the vertical support, and wherein a portion of the guide opening proximate the second end provides sufficient clearance permitting relative movements of the bolt in the guide hole needed for movement of the bolt and the abutment out of engagement.

15. A scaffold according to claim 6 including an actuating lug fixedly connected to the bolt, and at least one pin-camtrack arrangement at an end region of the diagonal support proximate the relatively higher hook which is displaceable between latched and delatched positions.

16. A scaffold according to claim 15 wherein the actuating lug has a substantially inverse U-shaped cross-section defining an apex extending about the bolt fixedly connected thereto.

17. A scaffold according to claim 16 wherein the end of the diagonal support proximate the relatively higher hook forms a flat end region, and wherein limbs of the actuating lug extending from an apex thereof face surfaces of the flat end region and are in sliding contact therewith.

18. A scaffold according to claim 15 wherein the pin-camtrack arrangement has a displacement region extending substantially parallel to an insertion direction for the bolt and a latch region located relatively remote from the vertical support and oriented approximately perpendicular to the insertion direction for the bolt.

19. A scaffold according to claim 17 wherein the pin-camtrack arrangement is formed in each limb of the actuating lug.

20. A scaffold according to claim 15 including at least two, substantially parallel, spaced-apart pin-camtrack arrangements.

21. A scaffold according to claim 1 wherein each diagonal support in its final diagonal position has a relatively lower hook and a relatively higher hook, and wherein the relatively higher and lower hooks and openings in the vertical supports engaged by them are configured so that it is impossible to extend the relatively higher hook into the opening associated with the relatively lower hook, and vice versa.

22. A scaffold according to claim 1 wherein at least some of the vertical supports have elongate holes at diametrically opposite locations on the vertical supports.

23. A method for inserting a diagonal support in a scaffold, the scaffold having vertical supports arranged behind one another and connected by transverse struts at specific vertical intervals, the vertical supports defining vertical axes and with the transverse struts forming carrier frames, floor panels arranged between transverse struts of neighboring carrier frames, the diagonal supports having longitudinal axes and, when installed, being arranged between at least some of the neighboring vertical supports, the diagonal supports including first and second hooks at respective ends thereof, the vertical supports including first and second elongate openings for engagement by the hooks of the diagonal supports arranged between the neighboring vertical supports and located at least substantially in a plane defined by the vertical axes, the openings in the neighboring vertical supports facing each other, the method comprising the steps of engaging the first hook of each diagonal support with the first opening by positioning the diagonal support in an inserting position, connecting the first hook to the first opening by extending the first hook into the first opening and swinging the diagonal support from an inserting position towards a final diagonal position, with the diagonal support in substantially the final diagonal position, moving the second hook in a direction substantially perpendicular to the vertical axes into the second elongate opening to thereby place the diagonal support in its inserted position, and securing the diagonal support in its inserted position to the neighboring vertical supports so that it withstands tensile and compressive forces.

* * * * *